United States Patent [19]

Araiza

[11] Patent Number: 4,591,224

[45] Date of Patent: May 27, 1986

[54] ELECTRICAL CONNECTOR

[76] Inventor: Sil Araiza, 1895 W. Commonwealth, Unit L, Fullerton, Calif. 92633

[21] Appl. No.: 709,768

[22] Filed: Mar. 8, 1985

[51] Int. Cl.[4] ..... H01R 4/24

[52] U.S. Cl. ..... 339/97 C; 339/210 M

[58] Field of Search ..... 339/97 R, 97 C, 97 P, 339/98, 99 R, 107, 210

[56] References Cited

U.S. PATENT DOCUMENTS

| | | | |
|---|---|---|---|
| 2,702,895 | 2/1955 | Pavlinetz | 339/97 C |
| 2,982,938 | 5/1961 | Klumpp, Jr. | 339/97 C |
| 3,924,917 | 12/1975 | Mumshower | 339/97 C |

FOREIGN PATENT DOCUMENTS

| | | | |
|---|---|---|---|
| 189641 | 12/1922 | United Kingdom | 339/97 C |

*Primary Examiner*—Joseph H. McGlynn

*Attorney, Agent, or Firm*—Francis X. LoJacono

[57] ABSTRACT

This invention relates to a female-connector unit arranged to be used with a flat ribbon-type wire having a plurality of flat conductive elements. The female connector includes a pair of oppositely positioned half sections which are coupled together by means of latching-tongue members, a pair of connector fingers being fixedly mounted between the half sections. This pair of connector fingers includes means for fixedly stapling them together and to the terminal end of the flat ribbon wire.

10 Claims, 7 Drawing Figures

ELECTRICAL CONNECTOR

BACKGROUND OF THE INVENTION

Field of the Invention

This invention relates generally to an electrical pin connector, and more particularly to a female-connector unit composed of several pairs of contact fingers which are secured in a two-part sectional housing having a self-crimping arrangement to establish a positive coupling between the paired contact fingers.

Problems and difficulties are being encountered in providing suitable electrical contact device, particularly those associated with ribbon-type wire assemblies. Most of the problems occur in the joining of the contact fingers with the wire ribbon which has flat conductive wires or other suitable materials enclosed therein. The electrical contact between the two opposing contact fingers must be such that the contact between the fingers and the respective pins of the male connector is firm and positive, so that the ends of the contact fingers are electrically coupled together with the wire ribbon sandwiched therebetween, thus providing a solderless contact connector.

Various types of ribbon connectors are employed at the present time, these having numerous shapes and cross-sectional configurations which have been designed to overcome the many inherent problems in the industry. However, most of these devices lose their integrity over a short life period. Also, many of the known devices are complicated to manufacture and assemble, and thus expensive to maintain, so that they become restrictive in their use.

SUMMARY OF THE INVENTION

The present invention has for an important object to provide an electrical connector for wire ribbons that is so designed and constructed that all of the well-established problems are readily overcome, wherein the present invention can be produced, assembled and placed in use with a minimal amount of production-time, material, and expense.

It is another object of the invention to provide a connector of this type that is produced as a unit comprising any suitable number of contact assemblies, wherein each contact assembly includes a pair of electrical contact fingers.

Yet another object of the present invention is to provide an electrical female connector that is used in combination with the flat ribbon wire, wherein the connector housing includes a first half section and a mating second half section, the sections being formed with a self-coupling arrangement and a means for crimping each opposing contact finger in a positive engagement with the other.

Still another object of the invention is to provide a female connector of this type wherein one finger of each contact is formed to include staple pins to staple the wire ribbon between the two opposing finger contacts, wherein the two half sections of the connector housing are arranged to define a stapling device so as to form the staple pins in a locking mode when the two sections are coupled together.

A further object of the invention is to provide a device of this character that is so constructed so as to make it easy to assemble, without the need for special tools.

It is a further object of the present invention to provide a device of this character that eliminates contact-by-contact insertion, as is now required with the other known connectors, the contacts being formed in a continuous contiguous manner so that several contacts can be readily positioned within the housing at one time, thus eliminating handling and mounting each individual contact.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only and wherein like reference numerals refer to like elements as shown and described herein.

DESCRIPTION OF THE PREFERRED EMBODIMENT

Figure 1:
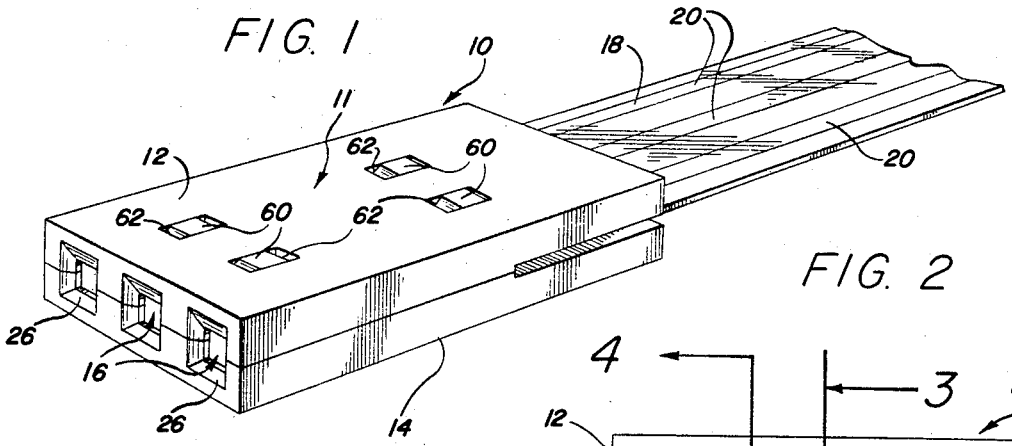
FIG. 1 is a perspective view of the present invention which is defined by a solderless electrical connector of the type employed for use with flat ribbon wire and/or flat conductive material.
Figure 2:
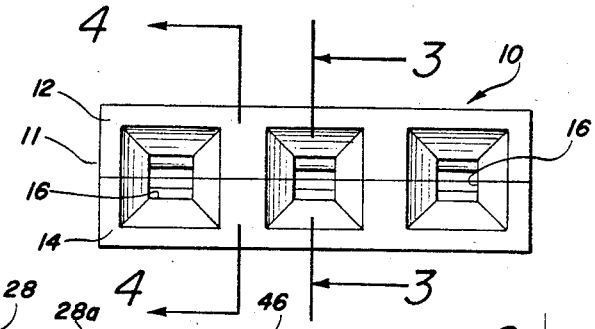
FIG. 2 is a front-elevational view showing a plurality of pin-receiving openings formed by the two half sections of the connector housing.

Referring to the drawings and more particularly to FIG. 1, there is illustrated a connector unit, generally indicated at 10, which includes a housing 11 having a first half section 12 and a second half section 14. The two sections are secured and coupled together, thus defining a plurality of pin-receiving openings 16 at the front end thereof which are adapted to fixedly retain a flat ribbon wire or other suitable flat conductive material 18 at the rearward portion.

As an example and for illustrative purposes, connector unit 10 is herein shown to be adapted to support three pairs of contact fingers, designated generally at 19. However, any number of contact fingers may be employed. This would be determined by the number of flat conductive elements 20 used in a given ribbon wire. As illustrated, ribbon wire 18 has three conductive strips or elements 20, wherein three matching pairs of contact fingers 19 are provided which are arranged to be mounted in three receptacle-connector housings.

Figure 6:
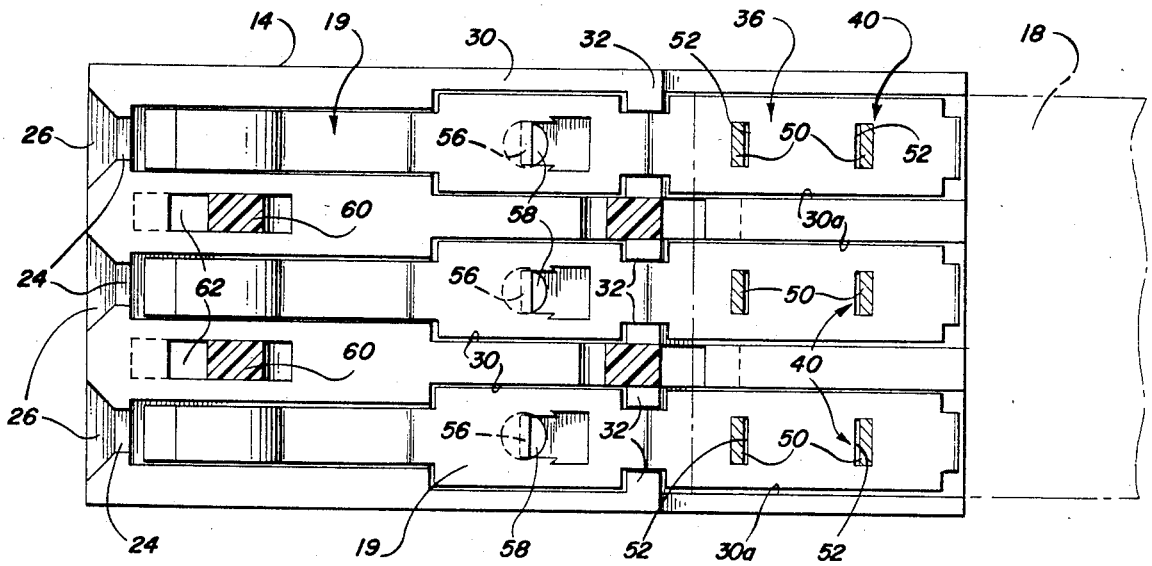
FIG. 6 is a longitudinal cross-sectional view taken substantially along line 6—6 of FIG. 3 with the ribbon wire shown in phantom lines.
Figure 7:
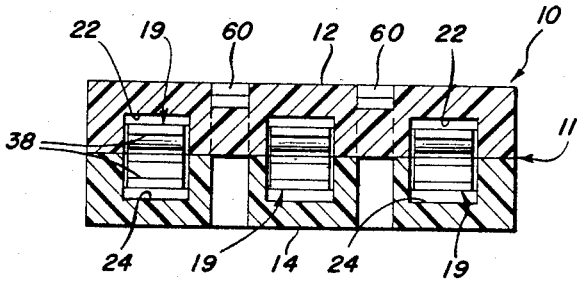
FIG. 7 is a transverse cross-sectional view taken along line 7—7 of FIG. 4.

The half sections 12 and 14 are formed somewhat alike, in that they both include means for mounting contact fingers therebetween, the means being defined by longitudinal channeled receptacles 22 and 24, respectively. The receptacles are located adjacent the opening 16 which is defined by open-faced notches 26, as illustrated in FIG. 6. Rearward of each receptacle 22 and 24, there is formed a continuous longitudinal groove 28 and 30, respectively, with inward projections 32. The rearward portions 28*a* and 30*a* of grooves 28 and 30 are more deeply recessed so as to readily accommodate contact fingers 19 together with the terminal end of the ribbon wire 18, as seen in the cross-sectional view of FIG. 3.

Figure 3:
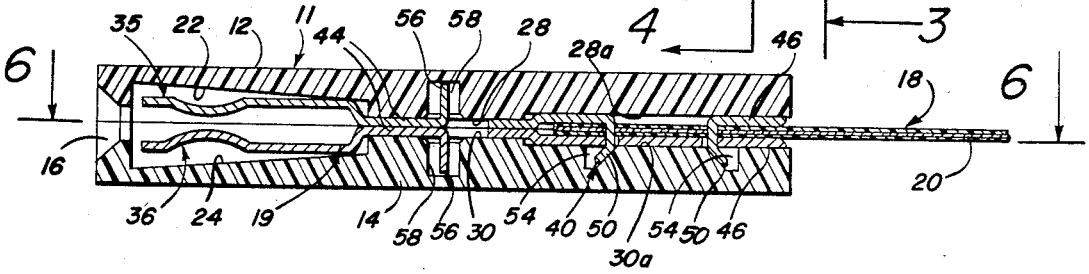
FIG. 3 is an enlarged cross-sectional view taken substantially along lines 3—3 of FIG. 2, showing the end of the ribbon wire being secured between the electrical contact fingers.
Figure 5:
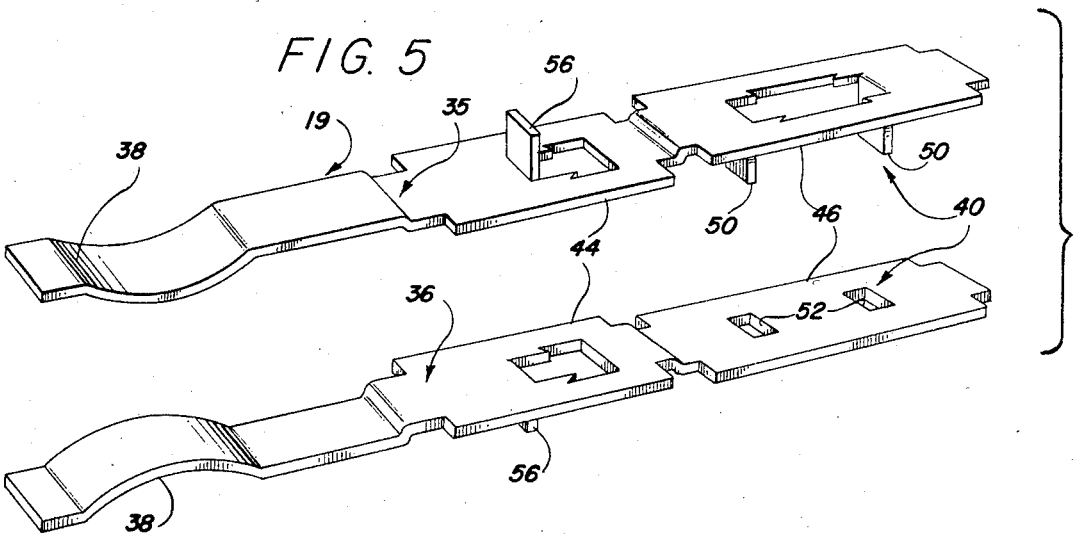
FIG. 5 is an exploded perspective view of the mating contact fingers prior to being secured together.

Accordingly, each pair of contact fingers 19 comprises a first finger member 35 and a second finger member 36 formed from a suitable conductive metal, the basic configuration including a flexible pin-engaging tongue 38. When contact fingers 19 are secured together by a stapling means, generally indicated at 40, their respective fingers are clasped together, one over the other so that the bowed section 42 of tongue 38 is arranged to grip the pin of a male plug (not shown). Each finger is further formed with an intermediate base section 44, followed by a rear base section 46. The intermediate base section 44 is arranged to be received in the corresponding grooves 28 and 30 of the respective half sections 12 and 14; and the rear base section 46 is arranged to be positioned within the corresponding rear grooves 28*a* and 30*a*. The opposing mid-base sections 44 are also arranged to be in full contact with each other when mounted in housing 11, as seen in FIG. 3. However, the corresponding rear base sections 46 are offset so as to be received in the respective grooves 28*a* and 30*a*, whereby a longitudinal space is defined therebetween to receive the terminal end of ribbon wire 18. The ribbon wire is fixedly secured between fingers 35 and 36 by stapling means 40 which comprises a pair of oppositely disposed staple pins 50 formed in the rear base section 46 of contact finger 35, and corresponding holes 52 formed in the rear base section 46 of contact finger 36. The contact finger is first positioned in grooves 30 and 30*a*, the groove 30*a* having wedge-shaped notches 54 over which holes 52 are aligned. Ribbon wire 18 is then placed over base section 46 of contact finger 36, after which the upper contact finger 35 is aligned so that staple pins 50 can be forced through holes 52 as the two half sections 12 and 14 are pressed together. The squeezing of the two half sections causes staple pins 50 to engage wedge-shaped notches 54. The tip ends of staple pins 50 are at this time bent in a stapling mode, as better seen in FIG. 3.

Further, alignment means are defined by outwardly bent alignment pins 56 which are formed in each mid-base section 44 of each opposing contact finger 35 and 36. When each pair of contact fingers 19 is interposed between the half sections 12 and 14, alignment pins 56 should fit within alignment bores 58 disposed in the middle of each half section. Thus, the contact fingers will always be mounted in the proper position.

It should be further noted that staple pins 50 also define contact terminals which are aligned with the respectively positioned conductive strips 20 of the ribbon wire 18. Pins 50 are stapled through the flat-wire, conductive strip 20—thus providing a firm, positive, electrical connection between the contact fingers and the conductive strips.

Figure 4:
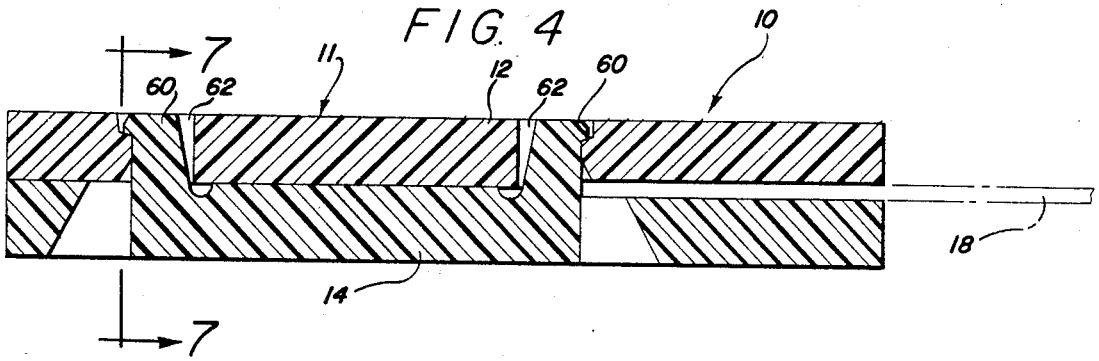
FIG. 4 is an enlarged cross-sectional view taken substantially along line 4—4 of FIG. 2, showing the coupling arrangement between the half sections defining the connector housing.

The two half sections of housing 11 are provided with coupling means, whereby the sections are secured together so as to encase the contact fingers therebetween, as previously described herein. The cross-sectional view of FIG. 4 shows the basic arrangement of the housing coupling means which comprises aligned latch tongues 60 formed in housing section 14. Since the housing sections are formed from a suitable plastic, tongue members 60 have a slightly flexible characteristic so that they are readily received and latched into corresponding openings 62 formed in housing section 12. Accordingly, when the two housing sections are forced together, the stapling of the contact fingers 35 and 36 to the ribbon wire will occur, followed by the latching of the housing sections to provide a complete female-connector unit 10. Again, it should be noted that the three openings as shown in FIG. 1 are for illustrative purposes only, and it should be understood that any number of contact groups may be employed to define a particular connector unit, as might be required.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. An electrical female-connector unit of the type used with ribbon wire having a plurality of flat conductive elements enclosed therein, said female-connector unit comprising:

a housing having a first housing section and a second housing section;

means formed between said housing sections for coupling said sections together to define said housing;

at least one pair of contact fingers mounted between said first and second housing sections, and adapted to receive a male-connector pin;

means formed in said housing sections and said contact finger for aligning said contact fingers longitudinally within said housing; and means formed in said contact fingers for stapling said fingers to each other and said ribbon wire, wherein said stapling means further defines terminal means for engaging said conductive elements of said ribbon wire.

2. An electrical female-connector unit as recited in claim 1, wherein a plurality of pairs of contact fingers is juxtaposed within said housing, and wherein connector-pin-receiving openings are formed in said housing adjacent each of said pairs of contact fingers.

3. An electrical female-connector unit as recited in claim 1, wherein said coupling means comprises:

a plurality of latch-tongue members formed in said second housing section; and a plurality of openings formed in said first housing section and adapted to receive said latch-tongue members for latching therein, whereby said housing sections are secured together to enclose said contact fingers therein.

4. An electrical female-connector unit as recited in claim 1, wherein each of said pairs of contact fingers includes:

a first contact finger; and a second contact finger;

wherein said contact fingers are mounted one above the other and in contact with each other at least along one section thereof.

5. An electrical female-connector unit as recited in claim 4, wherein each of said contact fingers comprises:

a flexible, connector-pin-engaging, tongue member;

an intermediate base member; and a rear base member offset from said intermediate base member;

wherein said stapling means is formed in said rear base member and said alignment means is formed in said intermediate base member.

6. An electrical female-connector unit as recited in claim 5, wherein said first and second housing sections comprise:

at least one open-faced notch formed in the front of each of said housing sections to define said connector-pin-receiving opening;

a receptacle positioned contiguously with said open-faced notch, and adapted to receive said flexible, connector-pin-engaging, tongue member of said respective contact finger;

a continuous longitudinal groove wherein said intermediate and rear base members are positioned; and an alignment bore centrally positioned in said groove so as to receive said alignment means therein.

7. An electrical female-connector unit as recited in claim 6, wherein said second housing section includes a pair of aligned and wedged notches, and wherein said stapling means comprises:

a pair of staple pins formed in said rear base member of said first contact finger; and a pair of aligned holes formed in said rear base member of said second contact finger, said holes being arranged to receive said staple pins therethrough, wherein said staple pins engage said wedged notches, causing said staple pins to bend in a stapling manner;

wherein said staple pins further define said terminal means whereby said staple pins engage said flat conductive elements of said ribbon.

8. An electrical female-connector unit as recited in claim 7, wherein said alignment means comprises an alignment pin formed in said intermediate base member, and positioned to be received in corresponding aligned holes in each housing section.

9. An electrical female-connector unit as recited in claim 8, wherein said coupling means comprises:

a plurality of latch-tongue members formed in said second housing section; and a plurality of corresponding openings formed in said first housing section and adapted to latchingly receive said latch-tongue members;

wherein said oppositely disposed, rear-base members are offset from one another so as to define a space therebetween to fixedly position the terminal end of said ribbon wire.

10. An electrical connector unit in combination with ribbon wire, comprising:

a ribbon wire having a plurality of flat conductive elements formed therein;

a connector housing having first and second half sections;

means formed in said half sections for coupling said sections together to define said connector housing;

at least one pair of contact fingers mounted between said first and second half sections and adapted to receive a male-connector pin;

alignment means formed in said contact fingers, whereby said fingers are positioned longitudinally within said housing; and stapling means formed adjacent one end of said contact fingers for fixedly securing said ribbon wire to said fingers;

wherein said stapling means provides an electrical contact between said contact fingers and said conductive elements of said ribbon wire.

* * * * *